US006132935A

United States Patent [19]

Kobayashi et al.

[11] Patent Number: 6,132,935

[45] **Date of Patent: *Oct. 17, 2000**

[54] NEGATIVE-WORKING IMAGE RECORDING MATERIAL

[75] Inventors: Fumikazu Kobayashi; Kazuyoshi Mizutani; Keitaro Aoshima, all of Shizuoka, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/691,371

[22] Filed: Aug. 2, 1996

[30] Foreign Application Priority Data

Dec. 19, 1995 [JP] Japan ..... 7-330618

[51] Int. Cl.[7] ..... G03C 1/73

[52] U.S. Cl. ..... 430/281.1; 430/285.1; 430/287.1; 430/270.1; 430/325; 430/944; 430/945

[58] Field of Search ..... 430/281.1, 285.1, 430/287.1, 270.1, 325, 945, 944

[56] References Cited

U.S. PATENT DOCUMENTS

| | | | |
|---|---|---|---|
| 3,580,719 | 5/1971 | Brinckman | 430/200 |
| 4,266,006 | 5/1981 | Uhlig et al. | 430/300 |
| 5,372,907 | 12/1994 | Haley et al. | 430/157 |
| 5,488,182 | 1/1996 | Kobayashi et al. | 568/660 |
| 5,741,619 | 4/1998 | Aoshima et al. | 430/175 |

FOREIGN PATENT DOCUMENTS

| | | |
|---|---|---|
| 0 542 572 A1 | 5/1993 | European Pat. Off. . |
| 0 589 309 A1 | 3/1994 | European Pat. Off. . |
| 0 713 143 | 5/1996 | European Pat. Off. . |
| 1245924 | 9/1971 | United Kingdom . |

OTHER PUBLICATIONS

Willard, Hobart H. et al. Instrumental Methods of Analysis, Sixth Ed. Chapter 7, Infrared Spectrophotometry, pp. 177–189, 1981.

*Primary Examiner*—Laura Werner
*Attorney, Agent, or Firm*—Sughrue, Mion, Zinn, Macpeak & Seas, PLLC

[57] ABSTRACT

A negative-working image recording material is disclosed, which comprises a substance which absorbs light to generate heat, a water-insoluble and aqueous alkali-soluble resin, and a phenol derivative having in its molecule from 4 to 8 benzene rings, at least one phenolic hydroxyl group and at least two groups represented by the following general formula (I):

$$-CH_2OR^1 \quad (I)$$

wherein $R^1$ represents a hydrogen atom, an alkyl group or an acyl group. The negative-working image recording material can perform recording independent of the emission wavelength of the exposing light source, particularly with light in the range of from near infrared to infrared (heat irradiation).

13 Claims, No Drawings

NEGATIVE-WORKING IMAGE RECORDING MATERIAL

FIELD OF THE INVENTION

The present invention relates to a negative-working image recording material which can be used as an offset printing master. More particularly, the present invention relates to a lithographic printing plate for so-called direct plate making process comprising directly making plate from digital signal such as computer signal.

BACKGROUND OF THE INVENTION

As systems for directly making plate from digital data from computer there have been heretofore proposed (1) an electrophotographic process, (2) a photopolymerization process which comprises exposure to Ar laser and post-processing in combination, (3) a process employing a laminate of a photosensitive resin and a silver salt photographic material, (4) a process employing a silver master, (5) a process which comprises destruction of a silicone rubber layer by discharge or laser, etc.

In the foregoing electrophotographic process (1), the processing required for charging, exposure and development is complicated, and the apparatus required is complicated and elaborate. Further, the foregoing photopolymerization process (2) requires a post-heating step. This process also requires a high sensitivity plate-making material which is difficult to handle in daylight (a bright room). Furthermore, the foregoing processes (3) and (4) each employ a silver salt that requires a complicated processing adding to cost. Further, the foregoing process (5) can attain a relatively high perfection but leaves something to be desired in the removal of silicone residual left on the surface of the printing plate.

On the other hand, laser has made remarkable progress in recent years. In particular, solid laser and semiconductor laser which emit light in the range of near infrared to infrared are now easily available with a high output and a small size. These lasers are very useful as exposure light sources for use in direct plate making from digital data from computer, etc. However, most practically useful photosensitive image recording materials absorb light in the wavelength range of not higher than 450 nm and thus cannot be exposed to these lasers for image recording. Thus, an image recording material which can perform recording independent of the wavelength of the exposure light.

As a technique enabling recording independent of the wavelength of the exposure light there is disclosed a positive-working image recording material comprising a compound which decomposes when acted on by light or heat (e.g., diazonium compound), a particulate substance which can absorb light and convert it to heat and a binder in JP-A-52-113219 (The term "JP-A" as used herein means an "unexamined published Japanese patent application"). When heated, this positive-working image recording material undergoes decomposition of a diazonium compound to record an image.

Further, JP-A-58-148792 discloses a positive-working photosensitive heat-sensitive recording material comprising as essential components a particulate thermoplastic resin, a photo-heat conversion substance and a photo-crosslinkable substance (e.g., diazonium compound). This type of a recording material utilizes a phenomenon that a particulate thermoplastic resin forms an image when acted on by heat and a photo-crosslinkable substance undergoes direct decomposition when acted on by light to give an image with an enhanced durability.

The direct plate-making process comprises scanning with a beam from a laser source to write an image. In this process, a negative-working material is preferably used because it can shorten the writing time. However, no negative-working image recording material having good recording properties has heretofore been known which can perform thermal recording by means of a solid laser or semiconductor laser (heat mode) having an emission wavelength range of from near infrared to infrared as an exposing light source for use in the direct plate-making from digital data from computer or the like.

SUMMARY OF THE INVENTION

It is therefore an object of the present invention to provide a negative-working image recording material which can perform recording independent of the emission wavelength of the exposing light source, particularly a negative-working image recording material which can perform recording with light in the wavelength range of from near infrared to infrared (heat radiation).

It is another object of the present invention to provide a negative-working lithographic printing plate for heat mode writing type direct plate making which can perform recording by means of a solid laser or semiconductor laser (heat mode) having an emission wavelength range of from near infrared to infrared to make a plate directly from digital data from computer or the like and make the direct application of conventional processors or printers.

The foregoing objects of the present invention can be accomplished by the following constitution (1) of the present invention:

(1) A negative-working image recording material comprising:
  (a) a substance which absorbs light to generate heat;
  (b) a water-insoluble and aqueous alkali-soluble resin; and
  (c) a phenol derivative having in its molecule from 4 to 8 benzene rings, at least one phenolic hydroxyl group and at least two groups represented by the following general formula (I):

$$-CH_2OR^1 \quad (I)$$

wherein $R^1$ represents a hydrogen atom, an alkyl group or an acyl group.

Further, the present invention has the following preferred embodiments (2) to (12):

(2) A negative-working image recording material comprising a substance which absorbs light to generate heat, a water-insoluble and aqueous alkali-soluble resin and a phenol derivative having in its molecule from 4 to 8 benzene rings, at least one phenolic hydroxyl group and at least two groups represented by the general formula (I), characterized in that said water-insoluble and aqueous alkali-soluble resin is a resin having a phenolic hydroxyl group or olefinically unsaturated bond;

(3) A negative-working image recording material comprising a support having thereon a substance which absorbs infrared rays or near infrared rays to generate heat, a water-insoluble and aqueous alkali-soluble resin having a phenolic hydroxyl group or olefinically unsaturated bond, and a phenol derivative having in its molecule from 4 to 8 benzene rings, at least one phenolic hydroxyl group and at least two groups represented by the general formula (I) shown above;

(4) The image recording material according to the embodiment (3), wherein as said substance which absorbs infrared rays or near infrared rays to generate heat there is used a dye;

(5) The image recording material according to the embodiment (3), wherein as said substance which absorbs infrared rays or near infrared rays to generate heat there is used a pigment;

(6) The image recording material according to the embodiment (3), wherein as said substance which absorbs infrared rays or near infrared rays to generate heat there is used carbon black;

(7) The image recording material according to the embodiment (3), wherein as said water-insoluble and aqueous alkali-soluble resin having a phenolic hydroxyl group or olefinically unsaturated bond there is used a novolak resin;

(8) The image recording material according to the embodiment (3), wherein as said water-insoluble and aqueous alkali-soluble resin having a phenolic hydroxyl group or olefinically unsaturated bond there is used an acrylic resin having an allyl group;

(9) The image recording material according to the embodiment (3), wherein as said water-insoluble and aqueous alkali-soluble resin having a phenolic hydroxyl group or olefinically unsaturated bond there is used an acrylic resin having a phenolic hydroxyl group;

(10) The image recording material according to the embodiment (3), wherein as said support there is used a polyester film;

(11) The image recording material according to the embodiment (3), wherein as said support there is used an aluminum plate;

(12) A negative-working image recording process, which comprises exposing a negative-working image recording material according to the embodiment (3) to infrared or near infrared rays emitted by a laser, and then developing the negative-working image recording material with an aqueous alkali;

(13) The negative-working image recording process according to the embodiment (12), wherein $R^1$ in the general formula (I) defined in the embodiment (3) is an alkyl group;

(14) The negative-working image recording process according to the embodiment (12), wherein $R^1$ in the general formula (I) defined in the embodiment (3) is a methyl group;

(15) A negative-working image recording process, which comprises exposing a negative-working image recording material according to the embodiment (3) to infrared rays or near infrared rays emitted by a laser, subjecting the negative-working image recording material to heat treatment, and then developing the negative-working image recording material with an aqueous alkali.

DETAILED DESCRIPTION OF THE INVENTION

The inventors made extensive studies. As a result, it was found that the combined use of a phenol derivative having in its molecule from 4 to 8 benzene rings, at least one phenolic hydroxyl group and at least two groups represented by the general formula (I) with a water-insoluble and aqueous alkali-soluble resin and a substance which absorbs light to generate heat can provide a negative-working image recording material which can perform recording independent of the wavelength of the exposing light source, particularly a negative-working image recording material which can perform recording with light in the range of from near infrared to infrared. Thus, the present invention has been worked out. The present invention comprises converting energy of exposing light to heat energy which is then used to cause condensation reaction by a phenol derivative, thereby recording an image.

The present invention is advantageous in that the use of a phenol derivative having in its molecule from 4 to 8 benzene rings provides a high sensitivity and a high film strength on the exposed area as compared with the use of a phenol derivative having in its molecule only from 1 to 3 benzene rings. If a phenol derivative having in its molecule not less than 9 benzene rings is used, it is disadvantageous in that the developability is deteriorated and the resulting image can be easily stained.

In the present invention, if the phenol derivative has two or more phenolic hydroxyl groups, it is advantageous in the developability after exposure. If the phenol derivative has four or more groups represented by the general formula (I), it is advantageous in that the film strength on the exposed area is raised.

In the present invention, if the substance which absorbs light to generate heat is a substance which absorbs infrared rays or near infrared rays to generate heat, it is advantageous in that the heat mode recording can be performed fairly.

In the present invention, if the substance which absorbs infrared rays or near infrared rays to generate is a dye, it is advantageous in the developability after exposure. Further, if the substance which absorbs infrared rays or near infrared rays to generate heat is a pigment, it is advantageous in that the resulting sensitivity is good. Further, if the substance which absorbs infrared rays or near infrared rays to generate heat is carbon black, it is advantageous in that the absorption wavelength range is wide and the resulting sensitivity is high.

In the present invention, as the support there can be advantageously used a polyester film to give a lighter weight. Further, an aluminum plate can be advantageously used to give a better dimensional stability.

The negative-working image recording material of the present invention is preferably applied to a negative-working image recording process which comprises exposing the negative-working image recording material to infrared rays or near infrared rays emitted by a laser, and then developing the negative-working image recording material with an aqueous alkali.

Preferred examples of the negative-working image recording material of the present invention include a negative-working heat-sensitive lithographic printing plate and a negative-working lithographic printing plate for heat mode writing type direct plate making.

The heat mode writing is a mode of writing in which a proper heat radiation source is controlled according to digital data to perform recording on the image recording material. As the heat radiation source there may be used a thermal head for use in facsimile, etc. or a laser emitting infrared rays or near infrared rays. If the thermal head is used, the resulting image has a low resolving power. Therefore, as the heat radiation source for direct plate making there is preferably used a laser emitting infrared rays or near infrared rays.

The present invention comprises converting light to heat via a photo-heat conversion substance, which heat is then used to cause crosslinking reaction. Thus, the present invention is essentially a photosensitive recording material. Preferred examples of radiations employable in the present invention include ultraviolet radiation, visible radiation, and infrared radiation. Among these radiations, infrared radiation is commonly called heat radiation. Thus, if recording is effected on the recording material of the present invention by infrared radiation, the recording material of the present invention may be referred to as heat-sensitive recording material.

The present invention will be further described hereinafter.

Preferred examples of the alkyl group represented by $R^1$ in the foregoing general formula (I) include Cl,, alkyl group such as methyl group, ethyl group, n-propyl group, isopropyl group, n-butyl group, isobutyl group, sec-butyl group and t-butyl group. Preferred examples of the acyl group represented by $R^1$ in the foregoing general formula (I) include formyl group, acetyl group, butyryl group, benzoyl group, cinnamoyl group, and valeryl group. Further, a $C_{1-4}$ substituted alkyl group such as methoxyethyl group, methoxypropyl group, hydroxyethyl group and hydroxypropyl group may be used.

The phenol derivative employable in the present invention can be obtained by reacting a known phenol compound such as those described in JP-A-1-289946, JP-A-3-179353, JP-A-3-200252, JP-A-3-128959, JP-A-3-200254, JP-A-5-158233, and JP-A-5-224409 with formaldehyde in a strongly alkaline medium at a temperature of from about 0° C. to 80° C., preferably from 10° C. to 60° C. for 1 to 30 hours. Thus, a phenol derivative wherein $R^1$ is a hydrogen atom can be obtained. Thereafter, the phenol derivative thus obtained may be reacted with a $C_{1-4}$ alcohol, substituted alcohol, acid halide or acid anhydride under acidic conditions at a temperature of from 0° C. to 80° C. for 1 to 30 hours to obtain a phenol compound wherein $R^1$ is an alkyl or acyl. The temperature at which the phenol derivative is reacted with an alcohol or substituted alcohol is preferably from 20° C. to 80° C. The temperature at which the phenol derivative is reacted with an acid halide or acid anhydride is preferably from 0° C. to 30° C.

Examples of the phenol derivative to be used in the present invention include compounds represented by the following general formulae (II) to (IX), but the present invention should not be construed as being limited thereto. These phenol derivatives may be used singly or in admixture. The amount of such a phenol derivative to be used is from 0.2 to 60% by weight, preferably from 0.5 to 20% by weight based on the weight of the photosensitive composition.

A compound having from 1 to 3 benzene rings, a phenolic hydroxyl group and a group represented by the general formula (I) causes the drop of inking property and development latitude. It is thus desirable that the photosensitive composition of the present invention be substantially free of such a compound. More preferably, the content of such a compound is not more than 5% by weight, even more preferably not more than 3% by weight, and most preferably 0% by weight.

(II)

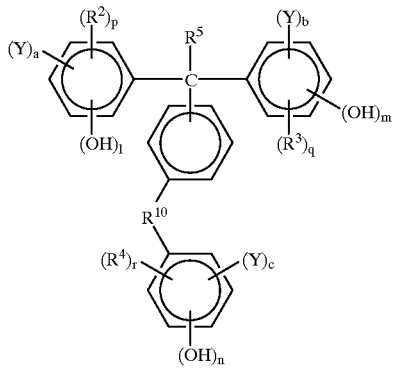

-continued (III)

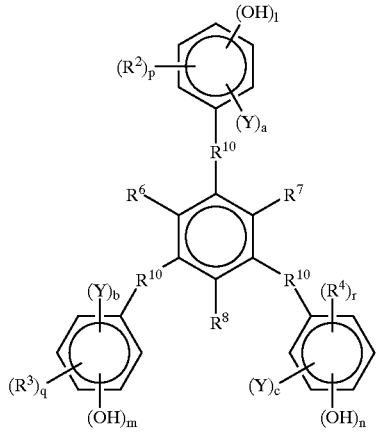

(IV)

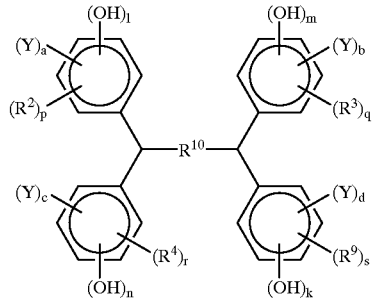

(V)

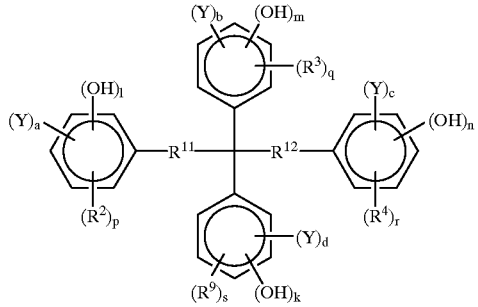

(VI)

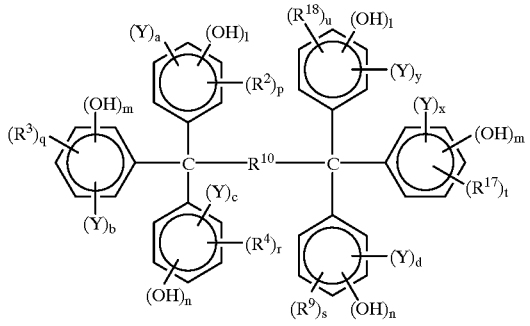

-continued (VII)

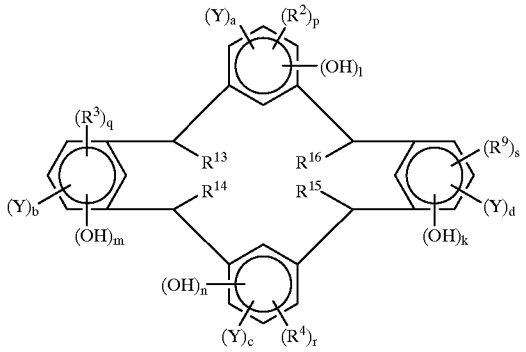

(VIII)

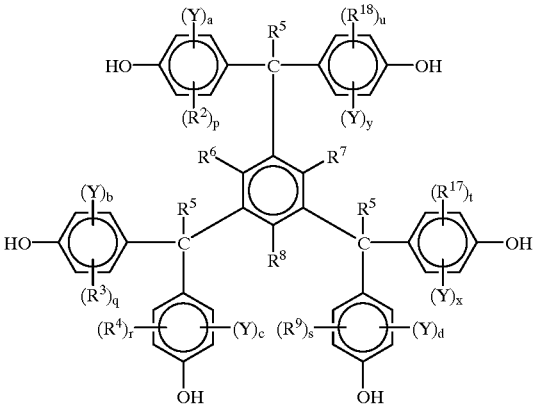

(IX)

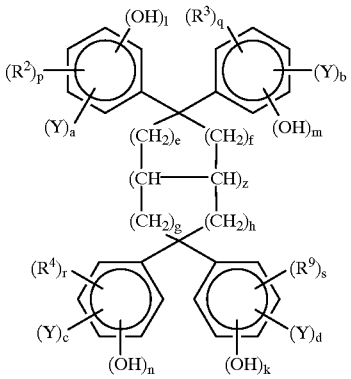

wherein $R^2$ to $R^4$, $R^9$, $R^{17}$ and $R^{18}$ each represents a hydrogen atom, a halogen atom, an alkyl group or an alkoxy group; $R^5$ and $R^{13}$ to $R^{16}$ each represents a hydrogen atom or an alkyl group; $R^6$ to $R^8$ each represents a hydrogen atom, a halogen atom or an alkyl group; $R^{10}$ to $R^{12}$ each represents a single bond, an alkylene, alkenylene, phenylene, naphthylene, carbonyl, ether or thioether group which may have a substituent, an amide bond or a combination of two or more of these bonds and groups; Y represents a group represented by the general formula (I); a, b, c, d, x and y each represents an integer of from 0 to 3, with the proviso that the sum of a, b, c, d, x and y is an integer of from 2 to 16; k, l, m and n each represents an integer of from 0 to 3, with the proviso that they are not 0 at the same time; e, f, g, h, p, q, r, s, t and u each represents an integer of from 0 to 3; and z represents an integer of 0 or 1.

Specific examples of the compounds represented by the foregoing general formulae (II) to (IX) include those having the following structural formulae:

(X)

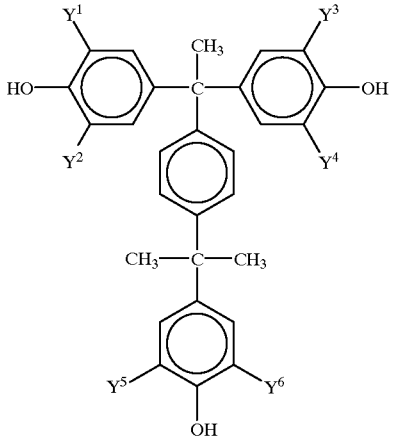

(XI)

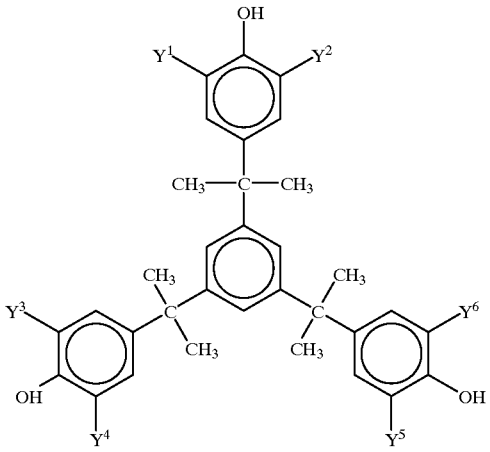

(XII)

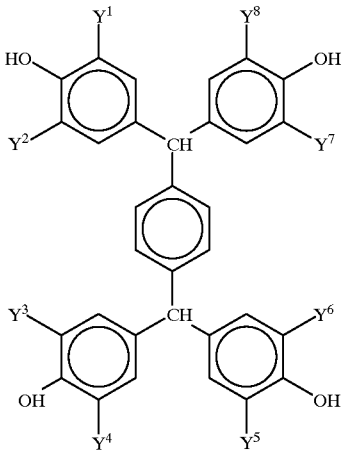

-continued (XIII)

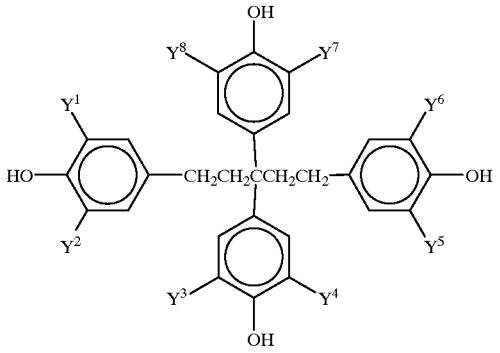

(XIV)

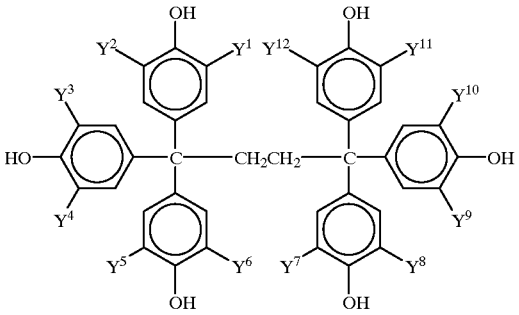

(XV)

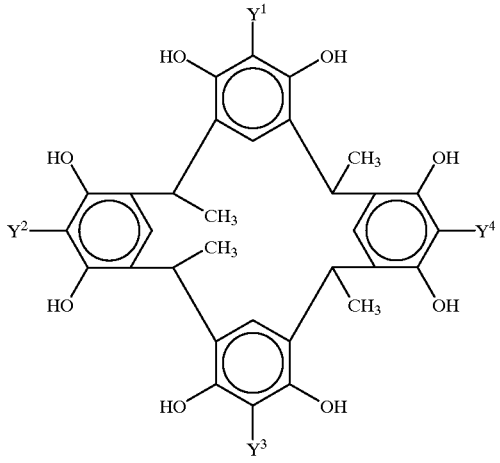

(XVI)

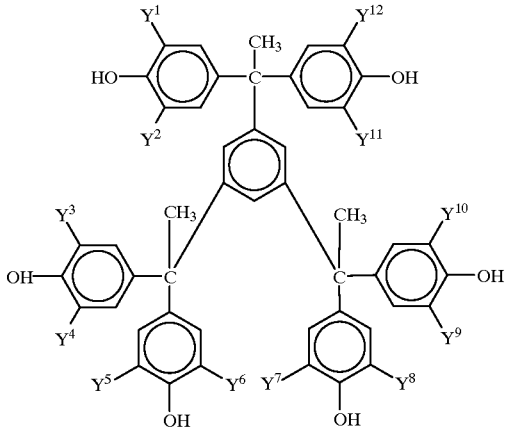

-continued (XVII)

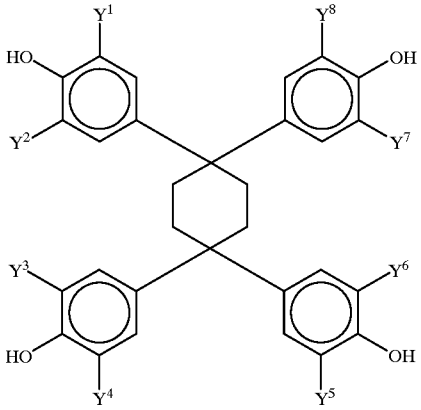

wherein $Y^1$ to $Y^{12}$ each represent a hydrogen atom or a group represented by the general formula (I), with the proviso that at least two of the various compounds have a group represented by the general formula (I). Preferably, $Y^1$ to $Y^{12}$ all are a group represented by the general formula (I).

In the present invention, as the substance which absorbs light to generate heat there may be used any pigment or dye.

As these pigments there may be used commercial pigments and pigments described in Handbook of Color Index (C.I.), "Handbook of Modern Pigments", Japan Pigment Technology Association (1977), "Applied Technology of Modern Pigments", CMC Shuppan (1986), and "Technology of Printing Ink", CMC Shuppan (1984).

Examples of these pigments include black pigment, yellow pigment, orange pigment, brown pigment, red pigment, purple pigment, blue pigment, green pigment, fluorescent pigment, and polymer-bound dye. Specific examples of the pigments employable herein include insoluble azo pigment, azo lake pigment, condensed azo pigment, chelate azo pigment, phthalocyanine pigment, anthraquinone pigment, perylene pigment, perinone pigment, thioindigo pigment, quinacridone pigment, dioxazine pigment, isoindolinone pigment, quinophthalone pigment, dyed lake pigment, azine pigment, nitroso pigment, nitro pigment, natural pigment, fluorescent pigment, inorganic pigment, and carbon black.

Such a pigment may be optionally subjected to surface treatment before use. Examples of possible surface treatment methods include a method which comprises coating the surface of the pigment with a resin or wax, a method which comprises attaching a surface active agent to the pigment, and a method which comprises bonding a reactive substance (e.g., silane coupling agent, epoxy compound, polyisocyanate) to the surface of the pigment. These surface treatment methods are further described in "Properties and Application of Metallic Soap", Sachi Shobo (1988), "Technology of Printing Ink", CMC Shuppan (1984), and "Applied Technology of Modern Pigments", CMC Shuppan (1986).

The grain diameter of the pigment is preferably from 0.01 to 10 $\mu$m, more preferably from 0.05 $\mu$m to 1 $\mu$m. As the method for dispersing the pigment there may be used any known dispersion method used in the production of ink or toner. Examples of dispersing apparatus which can be employed in these dispersing methods include ultrasonic dispersing machine, sand mill, attritor, pearl mill, supermill, ball mill, impeller, disperser, KD mill, colloid mill, dynatron, three-roll mill, and pressure kneader. These dispersing apparatus are further described in "Applied Technology of Modern Pigments", CMC Shuppan (1986).

As the dye there may be used any of commercial dyes and known dyes described in references (e.g., "Handbook of Dyes", The Society of Synthetic Organic Chemistry, Japan (1970)). Specific examples of dyes employable herein include azo dye, metal complex azo dye, pyrazolone azo dye, anthraquinone dye, phthalocyanine dye, carbonium dye, quinoneimine dye, methine dye, and cyanine dye.

Particularly preferred among these pigments or dyes are those which absorb infrared rays or near infrared rays.

As the pigment which absorbs infrared rays or near infrared rays there may be preferably used carbon black.

Examples of the dye which absorbs infrared rays or near infrared rays include cyanine dyes described in JP-A-58-125246, JP-A-59-84356, JP-A-59-202829, and JP-A-60-78787, methine dyes described in JP-A-58-173696, JP-A-58-181690, and JP-A-58-194595, naphthoquinone dyes described in JP-A-58-112793, JP-A-58-224793, JP-A-59-48187, JP-A-73996, JP-A-60-52940, and JP-A-60-63744, squarylium dyes described in JP-A-58-112792, and cyan dyes described in British Patent 434,875.

Further, near infrared absorbents described in U.S. Pat. No. 5,156,938 can be preferably used.

Further, substituted arylbenzo(thio)pyrylium salts disclosed in U.S. Pat. No. 3,881,924, trimethinethiapyrylium salts disclosed in JP-A-57-142645 (U.S. Pat. No. 4,327,169), pyrylium compounds disclosed in JP-A-58-181051, JP-A-58-220143, JP-A-59-41363, JP-A-59-84248, JP-A-59-84249, JP-A-59-146063, and JP-A-59-146061, cyanine dyes disclosed in JP-A-59-216146, pentamethinethiopyrylium salts disclosed in U.S. Pat. No. 4,283,475, and pyrylium compounds disclosed in JP-B-5-13514 (The term "JP-B" as used herein means an "examined Japanese patent publication") and JP-B-5-19702 are particularly preferred.

Another preferred example of dye is a near infrared absorbing dye represented by the general formula (I) or (II) disclosed in U.S. Pat. No. 4,756,993.

Such a pigment or dye may be incorporated in the image recording material in an amount of from 0.01 to 50% by weight, preferably from 0.1 to 20% by weight, more preferably from 0.5 to 15% by weight, based on the total solid content in the image recording material. If the content of the pigment or dye falls below 0.01% by weight, no desirable images can be obtained. On the contrary, if the content of the pigment or dye exceeds 50% by weight, the resulting negative-working image recording material is apt to stain on the non-image area during printing.

Such a dye or pigment may be incorporated in the same layer as the phenol derivative or in a layer provided separately of the phenol derivative. If the dye or pigment is incorporated in a separate layer, it is preferably incorporated in a layer adjacent to the layer in which the phenol derivative is incorporated.

The water-insoluble and aqueous alkali-soluble resin to be used in combination with the phenol derivative of the present invention will be further described hereinafter. As the water-insoluble and aqueous alkali-soluble resin there may be used any resin. In particular, a resin having a phenolic hydroxyl group or olefinically unsaturated bond is preferred. Preferred examples of such a resin include the following novolak resins.

Examples of such a novolak resin include cresolformaldehyde resin such as phenolformaldehyde resin, m-cresolformaldehyde resin, p-cresolformaldehyde resin, o-cresolformaldehyde resin, m-/p-mixed cresolformaldehyde resin and phenol/cresol-mixed formaldehyde resin (examples of cresol resin include m-cresolformaldehyde resin, p-cresolformaldehyde resin, o-cresolformaldehyde resin, m-/p-mixed cresolformaldehyde resin, m-/o-mixed cresolformaldehyde resin, and o-/p-mixed cresolformaldehyde resin). Besides these novolak resins, resol type phenolic resins are preferably used. Preferred examples of such a resol type phenolic resin include phenol/cresol-mixed formaldehyde resin (examples of cresol resin include m-cresolformaldehyde resin, p-cresolformaldehyde resin, o-cresolformaldehyde resin, m-/p-mixed cresolformaldehyde resin, m-/o-mixed cresolformaldehyde resin, and o-/p-mixed cresolformaldehyde resin). In particular, the resol type phenolic resins described in JP-A-61-217034 (corresponding to U.S. Pat. Nos. 4,732,840 and 4,842,983) are preferred.

Further, phenol-modified xylene resins, polyhydroxystyrene, polyhalogenated hydroxystyrene, and acrylic resins having a phenolic hydroxyl group described in JP-A-50-55406, JP-A-51-34711, JP-A-51-36129, JP-A-52-28401, JP-A-62-38454, (corresponding to U.S. Pat. No. 4,822,719); West German Patents 3,528,390 and 3,528,929, U.S. Pat. No. 4,724,195, JP-A-5-230139, JP-A-5-230140, and JP-A-7-333839 may be used. Each of the patents cited previously in this paragraph discloses acrylate of acrylamide polymer resins having a hydroxyphenyl pendant group as a side chain, i.e., acrylic resins having a phenolic hydroxyl group.

Examples of resin having an olefinically unsaturated bond which can be preferably used in the present invention include those described in JP-B-3-63740 (corresponding to U.S. Pat. No. 4,511,645), U.S. Pat. Nos. 3,376,138 (disclosing a prepolymer of an allyl ester of an unsaturated monobasic acid or a prepolymer of an allyl ester of an aliphatic carboxylic acid having two or more allyl groups, for example, acrylic copolymers containing allyl groups); and 3,556,793, (disclosing various allyl containing polymers, for example, acrylic polymers containing allyl groups); JP-A-52-988, and JP-B-60-37123. JP-A-52-988 corresponds to U.S. Pat. Nos. 4,079,041 and 4,158,730, and discloses crosslinkable polymers containing maleimide groups. JP-B-60-37123 corresponds to U.S. Pat. Nos. 4,079,041 and 4,163,097. The resin having an olefinically unsaturated bond preferably contains an alkali-soluble monomer as a copolymerizable component to enhance the developability of the negative-working image recording material in an aqueous alkaline developer.

As the alkali-soluble group there may be used an acidic group having a pKa value of not more than 14. Examples of such an acidic group include —$SO_3H$, —$OP(O)(OH)_2$, —$P(O)(OH)_{21}$ —COOH, —CONHCO—, —$CONHSO_2$—, —$SO_2NH$—, and phenolic OH group.

As the aqueous alkali-soluble resin there is preferably used one having a weight-average molecular weight of from 500 to 400,000 and a number-average molecular weight of from 200 to 150,000.

These aqueous alkali-soluble resins may be used singly or in combination. The amount of such an aqueous alkali-soluble resin to be incorporated is from 5 to 99% by weight, preferably from 30 to 95% by weight based on the total weight of the photosensitive composition as calculated in terms of solid content.

The image recording material of the present invention may optionally further comprise various additives incorporated therein.

For example, a multifunctional monomer having two or more radically polymerizable ethylenic double bonds per molecule may be incorporated in the image recording material layer. Examples of such a compound include ethylene glycol di(meth)acrylate, diethylene glycol di(meth)acrylate, polyethylene glycol di(meth)acrylate, hexane diol di(meth) acrylate, trimethylol ethane tri(meth)acrylate, trimethylol propane tri(meth)acrylate, and tri(meth)acrylate, tetra(meth) acrylate and hexa(meth)acrylate of pentaerythritol and dipentaerythritol. The amount of such a multifunctional monomer to be incorporated is normally not more than 30% by weight based on the image recording material.

Further examples of additives which can be incorporated in the image recording material layer include an alkylether for improving coatability (e.g., ethyl cellulose, methyl cellulose), a surface active agent (e.g., fluorine surface active agent), and a plasticizer for providing film softening property and abrasion resistance (e.g., tricresyl phosphate, dimethyl phthalate, dibutyl phthalate, trioctyl phosphate, tributyl phosphate, tributyl citrate, polyethylene glycol, polypropylene glycol). The amount of these additives to be incorporated depends on their purpose but is normally from 0.5 to 30% by weight based on the total solid content in the image recording material.

A representative example of printing-out agent for providing a visible image immediately after the heat generation due to exposure is a combination of a compound which releases an acid when heated due to exposure and an organic dye capable of forming a salt. Specific examples of such a printing-out agent employable herein include a combination of halogenide o-naphthoquinonediazide-4-sulfonate and a salt-forming organic dye as disclosed in JP-A-50-36209 and JP-A-53-8128, and a combination of a trihalomethyl compound and a salt-forming organic dye as disclosed in JP-A-53-36223 and JP-A-54-74728. As the image colorant there may be also used any dye other than the foregoing salt-forming organic dye. Preferred examples of dyes, including salt-forming organic dyes, include oil-soluble dyes and basic dyes. Specific examples of these dyes include Oil Yellow #101, Oil Yellow #130, Oil Pink #312, Oil Green BG, Oil Blue BOS, Oil Blue #603, Oil Black BY, Oil Black BS, Oil Black T-505 (available from Orient Chemical Industries, Inc.), Victoria Pure Blue, Crystal Violet (CI42555), Methyl Violet (CI42535), Rhodamine B (CI45170B), Malachite Green (CI42000), and Methylene Blue (CI52015).

The printing-out agent and dye are incorporated in the image recording material in an amount of from 0 to 30% by weight.

If the substance of the present invention which absorbs light to generate heat is used to obtain a visible image having a sufficient density, such a dye doesn't need to be added. For the purpose of accelerating crosslinking reaction, only a printing-out agent (acid generator) may be added.

The image recording material of the present invention may be provided by coating a support with the foregoing components in the form of solution or dispersion in a solvent. Examples of the solvent employable herein include methanol, ethanol, isopropyl alcohol, n-butyl alcohol, t-butyl alcohol, ethylene dichloride, cyclohexanone, acetone, methyl ethyl ketone, ethylene glycol, ethylene glycol monomethyl ether, ethylene glycol monoethyl ether, 2-methoxyethyl acetate, 1-methoxy-2-propanol, 1-methoxy-2-propyl acetate, N,N-dimethylformamide, N,N-dimethylacetamide, tetrahydrofuran, dioxane, dimethyl sulfoxide, ethyl acetate, methyl lactate, and ethyl lactate. These solvents may be used singly or in admixture.

A mixed solvent obtained by adding to such a solvent or mixed solvent a small amount of water or a solvent which doesn't dissolve phenol derivatives or high-molecular compounds therein, such as toluene, is preferred, too.

The concentration of the foregoing components (solid content) in the solvent is from 1 to 50% by weight.

If the solution or dispersion thus obtained is coated and dried, drying is preferably effected at a temperature of from 50° C. to 120° C. The drying process may comprise pre-drying at a low temperature and subsequent drying at a higher temperature. Alternatively, drying may be effected at a high temperature if the solvent and concentration are properly selected, though drying at 150° C. or higher is not desirable due to the heat-sensitive recording material.

The applied amount of the coating material depends on the purpose. If the negative-working image recording material is used e.g., as a photosensitive lithographic printing plate (heat-sensitive lithographic printing plate), the applied amount of the coating material is normally from 0.5 to 3.0 $g/m^2$ as calculated in terms of solid content. The less the applied amount of the coating material is, the higher is the sensitivity but the poorer are physical properties of photosensitive layer. If necessary, a matte or matte layer may be provided on the photosensitive layer. Further, an undercoating layer may also be provided on the photosensitive layer.

Examples of the support to be coated with an image recording material of the present invention include paper, paper laminated with a plastic (e.g., polyethylene, polypropylene, polystyrene), plate made of a metal such as aluminum (including aluminum alloy), zinc and copper, film made of a plastic such as cellulose diacetate, cellulose triacetate, cellulose propionate, cellulose acetate, cellulose acetobutyrate, cellulose butyrate, polyethylene terephthalate, polyethylene, polystyrene, polypropylene, polycarbonate and polyvinyl acetal, and paper or plastic film laminated or vacuum-metallized with the foregoing metals. Preferred among these support materials is a polyester film or aluminum plate. In particular, the aluminum plate has a remarkable dimensional stability. Thus, the use of such an aluminum plate advantageously provides a good dimensional stability. A still further example of the support which can be preferably used is a composite sheet obtained by laminating an aluminum sheet on a polyethylene terephthalate film as disclosed in JP-B-48-18327.

The support having a metallic surface, particularly aluminum surface, is preferably subjected to a proper hydrophilic treatment.

The hydrophilic treatment may be conducted as follows. For example, the surface of an aluminum plate is grained by a mechanical graining method such as wire brush graining, nylon brush graining with a slurry of abrasive grains and ball graining, a chemical graining with HF, $AlCl_3$ or HCl as an etchant, an electrolytic graining with nitric acid or hydrochloric acid as an electrolyte or a composite thereof, optionally etched with an acid or alkali, and then anodically oxidized with DC or AC current in sulfuric acid, phosphoric acid, oxalic acid, boric acid, chromic acid, sulfamic acid or mixture thereof to form a rigid passive film thereon.

Such a passive film can render the aluminum surface hydrophilic. If necessary, the aluminum surface thus treated is preferably subjected to treatment with silicate (e.g., sodium silicate, potassium silicate) as disclosed in U.S. Pat. Nos. 2,714,066 and 3,181,461, treatment with potassium fluorozirconate as disclosed in U.S. Pat. No. 2,946,638, treatment with phosphomolybdate as disclosed in U.S. Pat. No. 3,201,247, treatment with alkyl titanate as disclosed in British Patent 1,108,559, treatment with polyacrylic acid as disclosed in German Patent 1,091,433, treatment with polyvinylphosphonic acid as disclosed in German Patent 1,134,093 and British Patent 1,230,447, treatment with phosphonic acid as disclosed in JP-B-44-6409, treatment with phytic acid as disclosed in U.S. Pat. No. 3,307,951, composite treatment with a hydrophilic organic high-molecular compound and a divalent metal as disclosed in JP-A-58-16893 and JP-A-58-18291, or undercoating with a water-soluble polymer having a sulfonic group as disclosed in JP-A-59-101651 so that it is further rendered hydrophilic. Other examples of hydrophilic treatment include silicate electrodeposition as disclosed in U.S. Pat. No. 3,658,662.

As the active ray source for use in imagewise exposure there may be used a mercury vapor lamp, metal halide lamp, xenon lamp, chemical lamp, carbon-arc lamp or the like. Examples of radiation include electron rays, X rays, ion beam, and far infrared rays. Further, g-line, i-line, Deep-UV rays, and high density energy beam (laser beam) may be used. Examples of such a laser beam include helium-neon laser, argon laser, krypton laser, helium-cadmium laser, and KrF eximer laser. In the present invention, a light source which emits light in the range of near infrared to infrared is desirable. In particular, a solid laser or semiconductor laser is preferred.

As the developer for the negative-working image recording material according to the present invention or its replenisher there may be used any known aqueous alkaline solution. Examples of such an alkali include inorganic alkali salts such as sodium silicate, potassium silicate, sodium tertiary phosphate, potassium tertiary phosphate, ammonium tertiary phosphate, sodium secondary phosphate, potassium secondary phosphate, ammonium secondary phosphate, sodium carbonate, potassium carbonate, ammonium carbonate, sodium hydrogencarbonate, potassium hydrogencarbonate, ammonium hydrogencarbonate, sodium borate, potassium borate, ammonium borate, sodium hydroxide, ammonium hydroxide, potassium hydroxide, and lithium hydroxide. Alternatively, organic alkaline agents such as monomethylamine, dimethylamine, trimethylamine, monoethylamine, diethylamine, triethylamine, monoisopropylamine, diisopropylamine, triisopropylamine, n-butylamine, monoethanolamine, diethanolamine, triethanolamine, monoisopropanolamine, diisopropanolamine, ethyleneimine, ethylenediamine, and pyridine may be used. These alkaline agents may be used singly or in combination.

The developer or its replenisher may optionally comprise various surface active agents or organic solvents incorporated therein for the purpose of accelerating or inhibiting developability and enhancing dispersibility of development residue and ink-receptivity of the image area on the printing plate. Preferred examples of such surface active agents include anionic, cationic, nonionic and amphoteric surface active agents.

Further, the developer or its replenisher may optionally comprise a reducing agent such as hydroquinone, resorcin and sodium and potassium salt of inorganic acid such as sulfurous acid and hydrogensulfurous acid, organic carboxylic acid, defoaming agent, hard water softener, etc. incorporated therein.

Preferred examples of the developer employable herein include those described in JP-A-54-62004 and JP-B-57-7427, a developer composition comprising benzyl alcohol, an anionic surface active agent, an alkaline agent and water as disclosed in JP-A-51-77401, a developer composition comprising an aqueous solution containing benzyl alcohol, an anionic surface active agent and a water-soluble sulfurous acid as disclosed in JP-A-53-44202, and a developer composition comprising an organic solvent having a solubility to water of not more than 10% by weight at normal temperature, an alkaline agent and water as disclosed in JP-A-55-155355.

In the case where the image recording material according to the present invention is used as a printing plate, the negative-working image recording material which has been subjected to development with the foregoing developer and replenisher is preferably subjected to post-treatment with a rinsing solution containing a washing water and a surface active agent or a desensitizing solution containing gum arabic or a starch derivative. The post-treatment may comprise these treatments in combination.

In the recent plate-making and printing industry, automatic developing machines for printing plate have been widely used from the standpoint of the rationalization and standardization of plate-making process. These automatic developing machines normally consist of a development zone and a post-treatment zone. These automatic developing machines comprise an apparatus for carrying a printing plate, various processing tanks, and a spraying apparatus. In operation, various processing solutions which have been pumped up are sprayed through the respective nozzle onto an exposed printing plate which is being carried horizontally. A system has been recently known in which the printing plate is dipped in a processing solution tank filled with a processing solution while being carried guided by a submerged guide roll. In such an automatic processing process, the various processing solutions may be replenished by its replenisher depending on the throughput, operating time, etc.

Further, a so-called throwaway system which comprises processing with a substantially unused processing solution may be employed.

The present invention will be further described in the following examples, but the present invention should not be construed as being limited thereto.

SYNTHESIS EXAMPLE 1-1

(Synthesis A of Compound (X))

20 g of 1-[α-methyl-α-(4-hydroxyphenyl)ethyl]-4-[α,α-bis(4-hydroxyphenyl)ethyl]benzene (compound represented by the general formula (X) wherein $Y^1$ to $Y^6$ are a hydrogen atom at the same time) was dissolved in 100 ml of a 10% aqueous solution of potassium hydroxide. To this reaction solution was then added dropwise 60 ml of 37% formalin with stirring at room temperature in 1 hour. The reaction solution was further stirred at room temperature for 6 hours, and then poured into an aqueous solution of sulfuric acid to undergo crystallization. The paste precipitate thus obtained was thoroughly washed with water, and then recrystallized from 30 me of methanol to obtain a white powder (yield: 20 g).

The compound thus obtained was then identified as a hexamethylolated product of 1-[a-methyl-α-(4-hydroxyphenyl) ethyl]-4-[α,α-bis(4-hydroxyphenyl)ethyl] benzene (compound represented by the general formula (X) wherein $Y^1$ to $Y^6$ are a methylol group at the same time) by NMR. The purity of the hexamethylolated product was 92% as determined by reversed phase HPLC (column: Shimpac CLC-ODS (Shimadzu Corp.); solvent: methanol/water (mixing ratio=60/40 to 90/10 by volume)).

SYNTHESIS EXAMPLE 1-2

(Synthesis B of Compound (X))

20 g of the hexamethylolated product obtained in Synthesis Example 1-1 (compound represented by the general formula (X) wherein $Y^1$ to $Y^6$ are a methylol group at the same time) was dissolved in 1,000 ml of methanol under heating. To the solution was then added 1 ml of concentrated sulfuric acid. The reaction solution was then heated under reflux for 12 hours. The reaction solution was then allowed to cool. To the reaction solution was then added 2 g of potassium carbonate. The reaction mixture was stirred, and then concentrated. To the reaction solution was then added 300 ml of ethyl acetate. The reaction solution was washed with water, and then dried. The solvent was then distilled off to obtain a white solid (yield: 22 g).

The compound thus obtained was then identified as a hexamethoxymethylated product of 1-[α-methyl-α-(4-hydroxyphenyl)ethyl]-4-[α,α-bis(4-hydroxyphenyl)ethyl] benzene (compound represented by the general formula (X) wherein $Y^1$ to $Y^6$ are a methoxymethyl group at the same time) by NMR. The purity of the hexamethoxymethylated product was 90% as determined by reversed phase HPLC (column: Shimpac CLC-ODS (Shimadzu Corp.); solvent: methanol/water (mixing ratio=60/40 to 90/10 by volume)).

SYNTHESIS EXAMPLE 1-3

(Synthesis C of Compound (X))

20 g of the hexamethylolated product obtained in Synthesis Example 1-1 (compound represented by the general formula (X) wherein $Y^1$ to $Y^6$ are a methylol group at the same time) was dissolved in 1,000 ml of ethanol under heating. To the solution was then added 1 ml of concentrated sulfuric acid. The reaction solution was then heated under reflux for 12 hours. The reaction solution was then allowed to cool. To the reaction solution was then added 2 g of potassium carbonate. The reaction mixture was stirred, and then concentrated. To the reaction solution was then added 300 ml of ethyl acetate. The reaction solution was washed with water, and then dried. The solvent was then distilled off to obtain a colorless oily matter (yield: 22 g).

The purity of the hexaethoxymethylated product (compound represented by the general formula (X) wherein $Y^1$ to $Y^6$ are an ethoxymethyl group at the same time) was 70% as determined by reversed phase HPLC (column: Shimpac CLC-ODS (Shimadzu Corp.); solvent: methanol/water (mixing ratio=60/40 to 90/10 by volume)).

SYNTHESIS EXAMPLE 1-4

(Synthesis D of Compound (X))

20 g of the hexamethylolated product obtained in Synthesis Example 1-1 (compound represented by the general formula (X) wherein $Y^1$ to $Y^6$ are a methylol group at the same time) was dissolved in 200 ml of 1-methoxy-2-propanol under heating. To the solution was then added 1 ml of concentrated sulfuric acid. The reaction solution was then heated under reflux for 12 hours. The reaction solution was then allowed to cool. To the reaction solution was then added 2 g of potassium carbonate. The reaction mixture was stirred, and then concentrated. To the reaction solution was then added 300 ml of ethyl acetate. The reaction solution was washed with water, and then dried. The solvent was then distilled off to obtain a colorless oily matter (yield: 23 g).

The content of the hexaetherified product (compound represented by the general formula (X) wherein $Y^1$ to $Y^6$ are a 2-methoxy-1-methylethoxymethyl group at the same time) was 55% as determined by reversed phase HPLC (column: Shimpac CLC-ODS (Shimadzu Corp.); solvent: methanol/water (mixing ratio=60/40 to 90/10 by volume)).

SYNTHESIS EXAMPLE 1-5

(Synthesis E of Compound (X))

20 g of the hexamethylolated product obtained in Synthesis Example 1-1 (compound represented by the general formula (X) wherein $Y^1$ to $Y^6$ are a methylol group at the same time) was dissolved in 100 ml of methylene chloride under heating. To the solution was then added 10 ml of acetyl chloride. The reaction mixture was then stirred at a temperature of 25° C. for 12 hours. The reaction solution was washed with water, and then dried. The solvent was then distilled off to obtain a colorless oily matter (yield: 21 g).

The compound thus obtained was then identified as a hexakisacetoxymethylated product of 1-[α-methyl-α-(4-hydroxyphenyl)ethyl]-4-[α,α-bis(4-hydroxyphenyl)ethyl] benzene (compound represented by the general formula (X) wherein $Y^1$ to $Y^6$ are an acetoxymethyl group at the same time) by NMR. The purity of the hexakisacetoxymethylated product was 85% as determined by reversed phase HPLC (column: Shimpac CLC-ODS (Shimadzu Corp.); solvent: methanol/water (mixing ratio=60/40 to 90/10 by volume)).

SYNTHESIS EXAMPLE 2-1

(Synthesis A of Compound (XI))

17.3 g of α,α',α"-tris(4-hydroxyphenyl)-1,3,5-triisopropylbenzene (compound represented by the general formula (XI) wherein $Y^1$ to $Y^6$ are a hydrogen atom at the same time) was dissolved in 60 g of a 10% aqueous solution of sodium hydroxide. To the reaction solution was then added 15 g of methanol. To the reaction solution was then added dropwise 30 g of 37% formalin. After the completion of the dropwise addition, the reaction solution was heated to a temperature of 40° C. where it was then allowed to undergo reaction for 12 hours. The reaction solution was then crystallized from an aqueous solution of acetic acid to obtain a white solid. The white solid thus obtained was thoroughly washed with water, and then dried at room temperature under reduced pressure (yield: 20 g).

The compound thus obtained was then identified as a hexamethylolated product of α,α',α"-tris(4-hydroxyphenyl)-1,3,5-triisopropylbenzene (compound represented by the general formula (XI) wherein $Y^1$ to $Y^6$ are a methylol group at the same time) by NMR. The purity of the hexamethylolated product was 90% as determined by reversed phase HPLC (column: Shimpac CLC-ODS (Shimadzu Corp.); solvent: methanol/water (mixing ratio=60/40 to 90/10 by volume)).

SYNTHESIS EXAMPLE 2-2

(Synthesis B of Compound (XI))

20 g of the hexamethylolated product obtained in Synthesis Example 2-1 (compound represented by the general formula (XI) wherein $Y^1$ to $Y^6$ are a methylol group at the same time) was dissolved in 1,000 ml of methanol under heating. To the solution was then added 1 ml of concentrated sulfuric acid. The reaction solution was then heated under reflux for 9 hours. The reaction solution was then allowed to cool. To the reaction solution was then added 2 g of potassium carbonate. The reaction mixture was stirred, and then concentrated. To the reaction solution was then added 300 ml of ethyl acetate. The reaction solution was washed with water, and then dried. The solvent was then distilled off to obtain a colorless oily matter (yield: 22 g).

The purity of the hexakismethoxymethylated product (compound represented by the general formula (XI) wherein $Y^1$ to $Y^6$ are a methoxymethyl group at the same time) was 83% as determined by reversed phase HPLC (column: Shimpac CLC-ODS (Shimadzu Corp.); solvent: methanol/water (mixing ratio=60/40 to 90/10 by volume)).

SYNTHESIS EXAMPLE 3-1

(Synthesis A of Compound (XII))

10 g of α,α,α',α"-tetrakis(4-hydroxyphenyl)-p-xylene (compound represented by the general formula (XII) wherein $Y^1$ to $Y^8$ are a hydrogen atom at the same time) was dissolved in 25 ml of a 15% aqueous solution of sodium hydroxide. To the reaction solution was then added 15 ml of methanol. To the reaction solution was then added dropwise 20 g of 37% formalin. After the completion of the dropwise addition, the reaction solution was heated to a temperature of 40° C. where it was then allowed to undergo reaction for 12 hours. The reaction solution was then crystallized from an aqueous solution of acetic acid. The solid thus obtained was thoroughly washed with water, and then reslurried with 100 ml of ethyl acetate to obtain a white powder (yield: 11.4 g).

The compound thus obtained was then identified as an octamethylolated product of α,α,α',α'-tetrakis(4-hydroxyphenyl)-1,4-dimethylbenzene (compound represented by the general formula (XII) wherein $Y^1$ to $Y^8$ are a methylol group at the same time) by NMR. The purity of the octamethylolated product was 95% as determined by reversed phase HPLC (column: Shimpac CLC-ODS (Shimadzu Corp.); solvent: methanol/water (mixing ratio=60/40 to 90/10 by volume)).

SYNTHESIS EXAMPLE 3-2

(Synthesis B of Compound (XII))

20 g of the octamethylolated product obtained in Synthesis Example 3-1 (compound represented by the general formula (XII) wherein $Y^1$ to $Y^8$ are a methylol group at the same time) was dissolved in 1,000 ml of methanol under heating. To the solution was then added 1 ml of concentrated sulfuric acid. The reaction solution was then heated under reflux for 10 hours. The reaction solution was then allowed to cool. To the reaction solution was then added 2 g of potassium carbonate. The reaction mixture was stirred, and then concentrated. To the reaction solution was then added 300 ml of ethyl acetate. The reaction solution was washed with water, and then dried. The solvent was then distilled off to obtain a light yellow oily matter (yield: 21 g).

The purity of the octakismethoxymethylated product (compound represented by the general formula (XVI) wherein $Y^1$ to $Y^8$ are a methoxymethyl group at the same time) was 87% as determined by reversed phase HPLC (column: Shimpac CLC-ODS (Shimadzu Corp.); solvent: methanol/water (mixing ratio=60/40 to 90/10 by volume)).

SYNTHESIS EXAMPLE 3-3

(Synthesis C of Compound (XII))

20 g of the octamethylolated product obtained in Synthesis Example 3-1 (compound represented by the general formula (XII) wherein $Y^1$ to $Y^8$ are a methylol group at the same time) was dissolved in 800 ml of ethanol under heating. To the solution was then added 1 ml of concentrated sulfuric acid. The reaction solution was then heated under reflux for 12 hours. The reaction solution was then allowed to cool. To the reaction solution was then added 2 g of potassium carbonate. The reaction mixture was stirred, and then concentrated. To the reaction solution was then added 300 ml of ethyl acetate. The reaction solution was washed with water, and then dried. The solvent was then distilled off to obtain a colorless oily matter (yield: 23 g).

The purity of the octakisethoxymethylated product (compound represented by the general formula (XVI) wherein $Y^1$ to $Y^8$ are an ethoxymethyl group at the same time) was 72% as determined by reversed phase HPLC (column: Shimpac CLC-ODS (Shimadzu Corp.); solvent: methanol/water (mixing ratio=60/40 to 90/10 by volume)).

SYNTHESIS EXAMPLE 3-4

(Synthesis D of Compound (XII))

20 g of the octamethylolated product obtained in Synthesis Example 3-1 (compound represented by the general formula (XII) wherein $Y^1$ to $Y^8$ are a methylol group at the same time) was dissolved in 100 ml of methylene chloride under heating. To the solution was then added 10 ml of acetyl chloride. The reaction solution was then stirred at a temperature of 25° C. for 12 hours. The reaction solution was washed with water, and then dried. The solvent was then distilled off to obtain a colorless oily matter (yield: 22 g).

The purity of the octakisacetoxymethylated product (compound represented by the general formula (XII) wherein $Y^1$ to $Y^8$ are an acetoxymethyl group at the same time) was 75% as determined by reversed phase HPLC (column: Shimpac CLC-ODS (Shimadzu Corp.); solvent: methanol/water (mixing ratio=60/40 to 90/10 by volume)).

SYNTHESIS EXAMPLE 4-1

(Synthesis A of Compound (XIII))

11 g of 1,3,3,5-tetrakis(4-hydroxyphenyl)-pentane (compound represented by the general formula (XIII) wherein $Y^1$ to $Y^8$ are a hydrogen atom at the same time) was dissolved in 40 g of a 10% aqueous solution of sodium hydroxide. To this reaction solution was then added 10 g of methanol. To the reaction mixture was then added dropwise 20 g of 37% formalin. After the completion of the dropwise addition, the reaction solution was heated to a temperature of 40° C. where it was then further allowed to undergo reaction for 12 hours. The reaction solution was then crystallized from an aqueous solution of acetic acid to obtain a white viscous solid. The solid thus obtained was thoroughly washed with water, and then dried at room temperature under reduced pressure (yield: 13.6 g).

The compound thus obtained was then identified as an octamethylolated product of 1,3,3,5-tetrakis(4-hydroxyphenyl)-pentane (compound represented by the general formula (XIII) wherein $Y^1$ to $Y^8$ are a methylol group at the same time) by NMR. The purity of the octamethylolated product was 93% as determined by reversed phase HPLC (column: Shimpac CLC-ODS (Shimadzu Corp.); solvent: methanol/water (mixing ratio=60/40 to 90/10 by volume)).

SYNTHESIS EXAMPLE 4-2

(Synthesis B of Compound (XIII))

20 g of the octamethylolated product obtained in Synthesis Example 4-1 (compound represented by the general formula (XIII) wherein $Y^1$ to $Y^8$ are a methylol group at the same time) was dissolved in 1,000 ml of methanol under heating. To the solution was then added 1 ml of concentrated sulfuric acid. The reaction solution was then heated under reflux for 10 hours. The reaction solution was then allowed to cool. To the reaction solution was then added 2 g of potassium carbonate. The reaction mixture was stirred, and then concentrated. To the reaction solution was then added 300 ml of ethyl acetate. The reaction solution was washed with water, and then dried. The solvent was then distilled off to obtain a light yellow oily matter (yield: 21 g).

The purity of the octakismethoxymethylated product (compound represented by the general formula (XIII) wherein $Y^1$ to $Y^8$ are a methoxymethyl group at the same time) was 85% as determined by reversed phase HPLC (column: Shimpac CLC-ODS (Shimadzu Corp.); solvent: methanol/water (mixing ratio=60/40 to 90/10 by volume)).

SYNTHESIS EXAMPLE 5-1

(Synthesis A of Compound (XVI))

15 g of α,α,α',α',α",α"-hydroxyphenyl)-1,3,5-triethylbenzene (compound represented by the general formula (XVI) wherein $Y^1$ to $Y^{12}$ are a hydrogen atom at the same time) was dissolved in a mixture of 35 ml of a 15% aqueous solution of sodium hydroxide and 25 ml of methanol. To the reaction solution was then added dropwise 33 g of 37% formalin. After the completion of the dropwise addition, the reaction solution was heated to a temperature of 40° C. where it was then further allowed to undergo reaction for 20 hours. The reaction solution was then poured into an aqueous solution of acetic acid. A viscous oily matter was separated from the aqueous phase by decantation, thoroughly washed with water, and then dried at room temperature under reduced pressure to obtain a light yellow powder (yield: 16.6 g).

The compound thus obtained was then identified as a dodecamethylolated product of α,α,α',α',α",α"-hexakis(4-hydroxyphenyl)-1,3,5-triethylbenzene (compound represented by the general formula (XVI) wherein $Y^1$ to $Y^{12}$ are a methylol group at the same time) by NMR. The purity of the dodecamethylolated product was 80% as determined by reversed phase HPLC (column: Shimpac CLC-ODS (Shimadzu Corp.); solvent: methanol/water (mixing ratio= 60/40 to 90/10 by volume)).

SYNTHESIS EXAMPLE 5-2

(Synthesis B of Compound (XVI))

20 g of the dodecamethylolated product obtained in Synthesis Example 5-1 (compound represented by the general formula (XVI) wherein $Y^1$ to $Y^{12}$ are a methylol group at the same time) was dissolved in 1,000 ml of methanol under heating. To the solution was then added 1 ml of concentrated sulfuric acid. The reaction solution was then heated under reflux for 13 hours. The reaction solution was then allowed to cool. To the reaction solution was then added 2 g of potassium carbonate. The reaction mixture was stirred, and then concentrated. To the reaction solution was then added 300 ml of ethyl acetate. The reaction solution was washed with water, and then dried. The solvent was then distilled off to obtain a light yellow oily matter (yield: 21 g).

The purity of the dodecakismethoxymethylated product (compound represented by the general formula (XVI) wherein $Y^1$ to $Y^{12}$ are a methoxymethyl group at the same time) was 75% as determined by reversed phase HPLC (column: Shimpac CLC-ODS (Shimadzu Corp.); solvent: methanol/water (mixing ratio=60/40 to 90/10 by volume)).

Preparation of Substrate

A 0.3-mm thick aluminum plate (quality: 1050) was solvent-cleaned so that it was degreased, grained with a nylon brush and an aqueous suspension of 400-mesh pumice, and then thoroughly washed with water. The aluminum plate thus grained was dipped in a 25% aqueous solution of sodium hydroxide at a temperature of 45° C. for 9 seconds so that it was etched, washed with water, dipped in a 20% nitric acid for 20 seconds, and then washed with water. The etched amount of the grained surface of the aluminum plate was about 3 g/m$^2$. The aluminum plate thus treated was subjected to oxidation with a DC current in a 7% sulfuric acid as an electrolyte at a current density of 15 A/dm$^2$ to obtain an oxidized film having a density of 3 g/m$^2$, washed with water, and then dried. The aluminum plate thus oxidized was coated with the following undercoating solution, and then dried at a temperature of 80° C. for 30 seconds. The density of the undercoating layer after dried was 10 mg/m$^2$.

| (Undercoating solution) | |
|---|---|
| β-Alanine | 0.1 g |
| Phenylphosphonic acid | 0.05 g |
| Methanol | 40 g |
| Pure water | 60 g |

Preparation of Carbon Black Dispersion

The following components in the following weight proportion were subjected to dispersion with glass beads for 10 minutes to obtain a carbon black dispersion.

| | |
|---|---|
| Carbon black | 1 part by weight |
| Copolymer of benzyl methacrylate and methacrylic acid (molar ratio: 71:29; weight-average molecular weight: 70,000) | 1.6 parts by weight |
| Cyclohexane | 1.6 parts by weight |
| Methoxypropyl acetate | 3.8 parts by weight |

Preparation of Negative-Working Lithographic Printing Plate

EXAMPLES 1 TO 13 AND COMPARATIVE EXAMPLES 1 TO 4

The aluminum plate thus obtained was coated with the following photosensitive layer, and then dried at a temperature of 100° C. for 2 minutes to obtain a negative-working photosensitive lithographic printing plate. The density after dried was 2.0 g/m$^2$.

| Photosensitive layer | |
|---|---|
| Carbon black dispersion mentioned above | 2.4 g |
| Phenol derivative | (as set forth in Table 1) |
| Phenol-formaldehyde novolak (weight-average molecular weight: 12,000 | (as set forth in Table 1) |
| 4-(p-N,N-bis(ethoxycarbonylmethyl) aminophenyl-2,6-bis(trichloromethyl)-S-triazine | 0.02 g*[1] |
| Megafac F-176 (fluorinic surface active agent available from Dainippon Ink & Chemicals, Inc.) | 0.06 g |
| Methyl ethyl ketone | 15 g |
| 2-Methoxy-1-propanol | 12 g |

(*[1]Not added in Examples 1 and 2)

TABLE 1

| | Used amount | Phenol derivative | | | Printable |
|---|---|---|---|---|---|
| | of novolak (g) | General formula | Synthesis example | Used amount | number of sheets |
| Example 1 | 2.10 | (X) | Compound of Synthesis Example 1-1 | 0.21 | 30,000 |
| Example 2 | 2.00 | (X) | Compound of Synthesis Example 1-2 | 0.21 | 25,000 |
| Example 3 | 2.10 | (X) | Compound of Synthesis Example 1-3 | 0.20 | 30,000 |
| Example 4 | 2.05 | (X) | Compound of Synthesis Example 1-4 | 0.21 | 20,000 |
| Example 5 | 2.00 | (X) | Compound of Synthesis Example 1-5 | 0.22 | 35,000 |
| Example 6 | 2.07 | (XI) | Compound of Synthesis Example 2-1 | 0.21 | 30,000 |
| Example 7 | 2.07 | (XI) | Compound of Synthesis Example 2-2 | 0.21 | 30,000 |

TABLE 1-continued

| | Used amount | Phenol derivative | | | Printable |
|---|---|---|---|---|---|
| | of novolak (g) | General formula | Synthesis example | Used amount | number of sheets |
| Example 8 | 2.11 | (XII) | Compound of Synthesis Example 3-1 | 0.21 | 30,000 |
| Example 9 | 2.11 | (XII) | Compound of Synthesis Example 3-2 | 0.21 | 25,000 |
| Example 10 | 2.10 | (XII) | Compound of Synthesis Example 3-3 | 0.21 | 30,000 |
| Example 11 | 2.08 | (XIII) | Compound of Synthesis Example 4-1 | 0.21 | 25,000 |
| Example 12 | 2.08 | (XIII) | Compound of Synthesis Example 4-2 | 0.21 | 25,000 |
| Example 13 | 2.05 | (XVI) | Compound of Synthesis Example 5-1 | 0.20 | 30,000 |
| Comparative Example 1 | 2.10 | — | — | Not added | Image not formed |
| Comparative Example 2 | 2.09 | (X) | Starting material of Synthesis Example 1 | 0.20 | Image not formed |
| Comparative Example 3 | 2.12 | (XXI) | — | 0.22 | Image not formed |
| Comparative Example 4 | 2.10 | (XXII) | — | 0.22 | 10,000 |

The compound used in Comparative Example 2 was a compound represented by the general formula (X) wherein $Y^1$ to $Y^6$ are a hydrogen atom at the same time. The compounds (XXI) and (XXII) used in Comparative Examples 3 and 4 have the following structures having one and two benzene nuclei, respectively. These compounds are described in JP-B-1-49932.

(XXI)

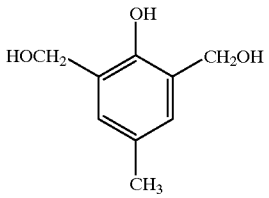

(XXII)

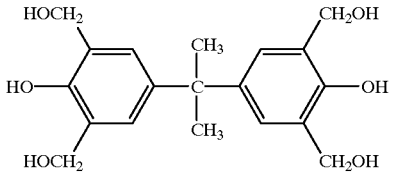

The negative-working photosensitive lithographic printing plate thus obtained was exposed to light beam from a YAG laser which had been adjusted such that the output thereof was 700 mW on the surface of the printing plate, and then processed through an automatic processor filled with a developer DP-4 (1 : 8) available from Fuji Photo Film Co., Ltd. and a rinsing solution FR-3 (1:7) available from Fuji Photo Film Co., Ltd. to obtain a negative image. The lithographic printing plate was then used in printing by a Hidel SOR-KZ printer. The results are set forth in Table 1. Examples 1 to 13, in which the phenol derivatives of the present invention were used, gave good printed matters. On the contrary, the comparative examples, free of phenol derivatives of the present invention, could form no image. In Comparative Example 4, which formed an image, the printable number of sheets was small.

COMPARATIVE EXAMPLE 5

The procedure of Example 1 was followed to prepare a negative-working photosensitive lithographic printing plate except that the photosensitive solution was prepared free of carbon black dispersion. The photosensitive lithographic printing plate thus prepared was exposed to light, and then developed in the same manner as in Example 1. As a result, the photosensitive film was totally dissolved in the developer. Thus, no image was obtained.

EXAMPLES 14 TO 19 AND COMPARATIVE EXAMPLES 6 AND 7

The same aluminum plate as used in Examples 1 to 13 was coated with the following photosensitive layer, and then dried at a temperature of 100° C. for 2 minutes to obtain a negative-working photosensitive lithographic printing plate. The density after dried was 2.0 g/m$^2$.

| Photosensitive layer | |
|---|---|
| Carbon black dispersion mentioned above | 2.2 g |
| Phenol compound of Synthesis Example 1–2 | 0.25 g |
| Alkali-soluble resin mentioned below | 2.05 g |
| Megafac F-176 (fluorinic surface active agent available from Dainippon Ink & Chemicals, Inc.) | 0.06 g |
| Methyl ethyl ketone | 15 g |
| 2-Methoxy-1-propanol | 12 g |

EXAMPLE 14

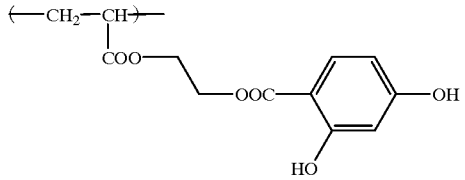

EXAMPLE 15

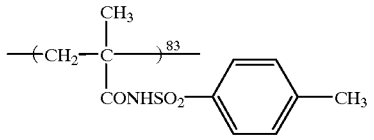

-continued

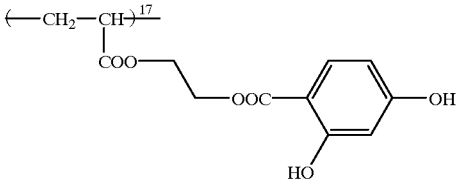

EXAMPLE 16

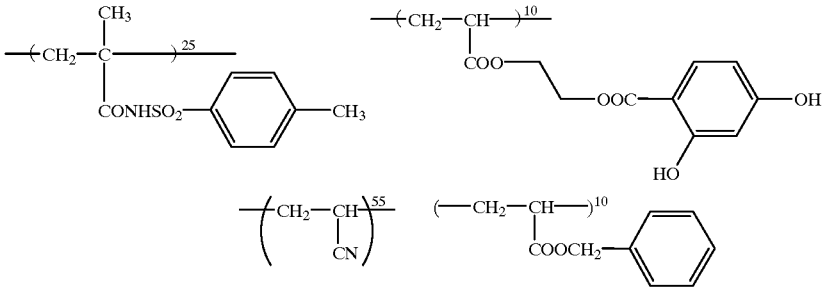

EXAMPLE 17

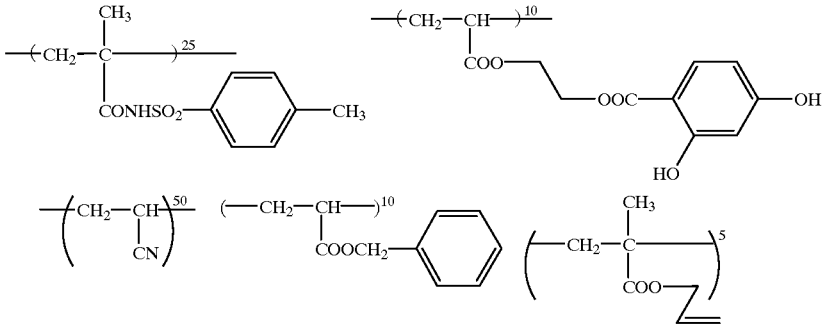

EXAMPLE 18

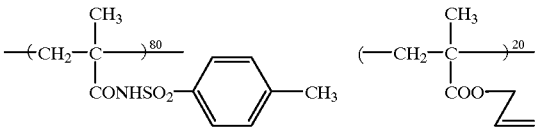

EXAMPLE 19

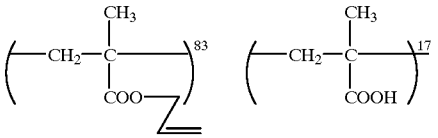

COMPARATIVE EXAMPLE 6

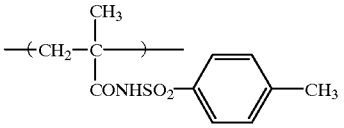

COMPARATIVE EXAMPLE 7

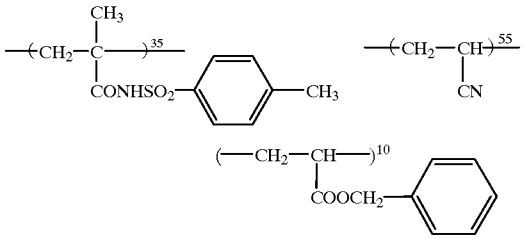

Composition Ratio is Represented by Mol

The negative-working photosensitive lithographic printing plate thus obtained was exposed to light beam from a YAG laser which had been adjusted such that the output thereof was 700 mW on the surface of the printing plate, and then developed with an aqueous solution containing sodium carbonate and sodium hydrogencarbonate. As a result, Examples 14 to 19, in which an acrylic resin having phenol ring or allyl group was used, gave a negative image. On the contrary, in Comparative Examples 6 and 7, in which an acrylic resin free of phenol ring or allyl group was used, the photosensitive film was totally dissolved in the developer, and no image was thus obtained.

EXAMPLES 20 TO 22 AND COMPARATIVE EXAMPLES 8 AND 9

A photosensitive layer which had comprised a dye set forth in Table 2 instead of the carbon black dispersion used in Example 1 was applied to the substrate, and then dried in the same manner as in Example 1 to obtain a negative-working photosensitive lithographic printing plate.

| Photosensitive solution | |
|---|---|
| Dye set forth in Table 2 | 0.2 g |
| Phenol compound of Synthesis Example 1–2 | (as set forth in Table 2) |
| Phenol-formaldehyde novolak (weight-average molecular weight: 12,000) | (as set forth in Table 2) |
| 4-(p-N,N-bis(ethoxycarbonylmethyl) aminophenyl)-2,6-bis(trichloromethyl)-S-triazine | 0.02 g*2 |
| Megafac F-176 (fluorinic surface active agent available from Dainippon Ink & Chemicals, Inc.) | 0.06 g |
| Methyl ethyl ketone | 15 g |
| 2-Methoxy-1-propanol | 12 g |

(*2Not added in Example 21)

TABLE 2

| | Dye | Used amount of phenol compound (g) | Printable number of sheets |
|---|---|---|---|
| EXAMPLE 20 | 1 | 0.35 | 25,000 |
| EXAMPLE 21 | 1 | 0.34 | 20,000 |
| EXAMPLE 22 | 2 | 0.35 | 25,000 |
| Comparative Example 8 | Not added | 0.34 | Image not formed |
| Comparative Example 9 | 1 | Not added | Image not formed |

Dye 1

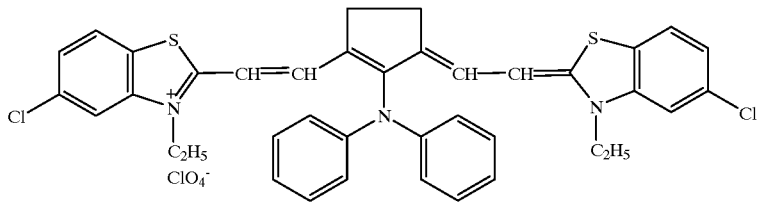

Dye 2

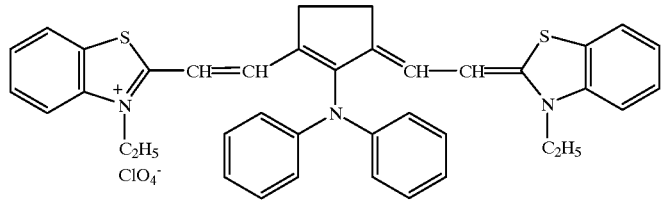

The negative-working photosensitive lithographic printing plate thus obtained was exposed to light from a semiconductor laser (wavelength: 825 nm; spot diameter: $1/e^2$= 11.9 $\mu$m) which had been adjusted such that the output thereof was 110 mW on the surface of the printing plate at a linear speed of 8 m/sec. The printing plate thus exposed was then developed in the same manner as in Example 1. As a result, in Examples 20 to 22, a fine line having a width of 10 $\mu$m was formed. The lithographic printing plate thus obtained was then used to print on a high quality paper with a commercial ink by a Type SOR-KZ printer available from Hidelberger Druckmaschinen Aktiengeseleschaft. The results are set forth in Table 2. Examples 20 to 22, in which the phenol derivative of the present invention was used in combination with a dye, gave good printed matters. On the contrary, Comparative Example 8, which was free of dye, and Comparative Example 9, which was free of phenol derivative of the present invention, formed no image.

The negative-working image recording material of the present invention can perform recording independent of the emission wavelength of the exposing light source. In particular, the negative-working image recording material of the present invention can perform recording with light in the range of from near infrared to infrared (heat radiation).

The recording material of the present invention can perform recording by means of a solid laser or semiconductor laser (heat mode) having an emission wavelength range of from near infrared to infrared to make a plate directly from digital data from computer or the like. Further, a heat mode writing type direct plate making process with the recording material of the present invention which can make the direct application of conventional processors or printers can provide a lithographic printing plate.

While the invention has been described in detail and with reference to specific embodiments thereof, it will be apparent to one skilled in the art that various changes and modifications can be made therein without departing from the spirit and scope thereof.

What is claimed is:

1. A negative-working lithographic printing plate comprising a support having thereon (1) a photosensitive layer comprising the following components (a), (b) and (c), or (2) a photosensitive layer comprising the following component (a) and a separate layer comprising the following components (b) and (c): (a) a substance which absorbs infrared rays or near infrared rays to generate heat, which substance is a dye selected from the group consisting of azo dyes, anthraquinone dyes, phthalocyanine dyes, carbonium dyes, quinoneimine dyes, methine dyes, and cyanine dyes (b) a water-insoluble and aqueous alkali-soluble resin having a phenolic hydroxyl group or olefinically unsaturated bond and (c) a phenol derivative composed of 4 to 8 benzene rings in which there is present at least one phenolic hydroxyl group and at least two groups represented by the general formula (I):

$$—CH_2OR^1 \quad (I)$$

wherein $R^1$ represents a hydrogen atom, an alkyl group or an acyl group.

2. The lithographic printing plate as claimed in claim 1, wherein said azo dye is selected from the group consisting of a metal complex azo dye and a pyrazolone azo dye.

3. The lithographic printing plate as claimed in claim 1, wherein as said support there is used a polyester film.

4. The lithographic printing plate as claimed in claim 1, wherein as said support there is used an aluminum plate.

5. A negative-working lithographic printing plate comprising a support having thereon (1) a photosensitive layer comprising the following components (a), (b) and (c), or (2) a photosensitive layer comprising the following component (a) and a separate layer comprising the following components (b) and (c): (a) a substance which absorbs infrared rays or near infrared rays to generate heat, which substance is a pigment selected from the group consisting of black pigments, yellow pigments, orange pigments, brown pigments, red pigments, purple pigments, blue pigments, green pigments, fluorescent pigments and polymer-bound dyes, (b) a water-insoluble and aqueous alkali-soluble resin having a phenolic hydroxyl group or olefinically unsaturated bond and (c) a phenol derivative composed of 4 to 8 benzene rings in which there is present at least one phenolic hydroxyl group and at least two groups represented by the general formula (I):

$$—CH_2OR^1 \quad (I)$$

wherein $R^1$ represents a hydrogen atom, an alkyl group or an acyl group.

6. The lithographic printing plate as claimed in claim wherein as said substance which absorbs infrared rays or near infrared rays to generate heat there is used a black pigment.

7. The lithographic printing plate as claimed in claim 6, wherein the black pigment is carbon black.

8. The lithographic printing plate as claimed in claim 5, wherein as said support there is used a polyester film.

9. The lithographic printing plate as claimed in claim 5, wherein as said support there is used an aluminum plate.

10. A negative-working image recording process, which comprises the steps of exposing a negative-working lithographic printing plate to infrared or near infrared rays emitted by a laser, and then developing the negative-working lithographic printing plate with an aqueous alkali, wherein the lithographic printing plate comprises a support having thereon (1) a photosensitive layer comprising the following components (a), (b) and (c), or (2) a photosensitive layer comprising the following component (a) and a separate layer comprising the following components (b) and (c): (a) a substance which absorbs infrared rays or near infrared rays to generate heat, which substance is a dye selected from the group consisting of azo dyes, anthraquinone dyes, phthalocyanine dyes, carbonium dyes, quinoneimine dyes, methine dyes, and cyanine dyes or is a pigment selected from the group consisting of black pigments, yellow pigments, orange pigments, brown pigments, red pigments, purple pigments, blue pigments, green pigments, fluorescent pigments and polymer-bound dyes, (b) a water-insoluble and aqueous alkali-soluble resin having a phenolic hydroxyl group or olefinically unsaturated bond and (c) a phenol derivative composed of 4 to 8 benzene rings in which there is present at least one phenolic hydroxyl group and at least two groups represented by the general formula (I):

$$—CH_2OR^1 \quad (I)$$

wherein $R^1$ represents a hydrogen atom, an alkyl group or an acyl group.

11. The negative-working image recording process as claimed in claim 10, wherein $R^1$ in the general formula (I) is an alkyl group.

12. The negative-working image recording process as claimed in claim 10, wherein $R^1$ in the general formula (I) is a methyl group.

13. The negative-working image recording process as claimed in claim 10, further comprising the step of subjecting the negative-working lithographic printing plate to heat treatment between the exposing step and the developing step.

* * * * *